US005598058A

United States Patent [19]

LaPointe

[11] Patent Number: 5,598,058

[45] Date of Patent: Jan. 28, 1997

[54] MULTI-COLOR ELECTROLUMINESCENT DISPLAY

[75] Inventor: Bradley J. LaPointe, Shorewood, Minn.

[73] Assignee: Leading Edge Industries, Inc., Minnetonka, Minn.

[21] Appl. No.: 388,062

[22] Filed: Feb. 9, 1995

[51] Int. Cl.[6] ..... H01J 1/62

[52] U.S. Cl. ..... 313/503; 313/509

[58] Field of Search ..... 313/502, 503, 313/506, 509, 510, 513; 40/544; 445/36, 45; 362/23

[56] References Cited

U.S. PATENT DOCUMENTS

| | | | |
|---|---|---|---|
| 2,925,532 | 2/1960 | Larach | 315/169 |
| 3,496,410 | 2/1970 | MacIntyre | 313/510 |
| 4,027,192 | 5/1977 | Hanak | 313/503 |
| 4,862,033 | 8/1989 | Migita et al. | 313/502 |
| 4,908,603 | 3/1990 | Yamaue et al. | 340/525 |
| 5,043,715 | 8/1991 | Kun et al. | 340/781 |
| 5,047,686 | 9/1991 | Robertson | 313/503 |
| 5,239,227 | 8/1993 | Kikinis | 313/506 |
| 5,294,869 | 3/1994 | Tang et al. | 313/504 |
| 5,294,870 | 3/1994 | Tang et al. | 313/504 |

OTHER PUBLICATIONS

"Technical Guidebook of the Screen Printing Industry", Screen Printing Association International Daniel Levine, Reproduction Photography, 1982 vol. I, C1.

"Technical Guidebook of the Screen Printing Industry", Screen Printing Association International Hans–Gerd Scheer, Four–Color Halftones in Screen Printing, 1982 vol. I, C7.

*Primary Examiner*—Michael Horabik
*Assistant Examiner*—Michael Day
*Attorney, Agent, or Firm*—Michael J. Weins

[57] ABSTRACT

A thick-film multi-color electroluminescent display (10) includes a transparent substrate (12), a transparent electrode (14) deposited on the substrate (12), a phosphor layer (16) deposited on the transparent electrode (14) having two regions (18, 20) having different compositions providing visually distinct spectra of light when placed in a common electric field, a dielectric layer (22) deposited on the phosphor layer (16), and a second electrode (24) deposited on the dielectric layer (22). In an alternate embodiment, the phosphor layer (16) is composed of a marbled ink having a mixture of a first phosphor ink and a second phosphor ink having different compositions providing visually distinct spectra of light when placed in a common electric field. In another alternate embodiment, the phosphor layer (16) is composed of at least two halftone screen prints corresponding to at least two phosphor compositions providing visually distinct spectra of light when placed in a common electric field.

6 Claims, 7 Drawing Sheets

MULTI-COLOR ELECTROLUMINESCENT DISPLAY

FIELD OF THE INVENTION

The present invention relates to an electroluminescent lamp and more particularly to one which provides a multi-color display and method for making the same.

BACKGROUND OF THE INVENTION

There have been a variety of lighted signs which use a lamp in combination with a cover screen to provide a multi-color display such as the red and white exit sign used in buildings. Such displays present a visible image at all times even when the lamp is not energized.

The development of multi-color electroluminescent displays has a long history with much of its early development directed toward color television. The displays developed have been based on thin film technology which either provides multiple arrays of coplanar pixels or arrays of non-coplanar phosphor elements. In either case, the phosphor elements have characteristics which emit at different wavelengths in the visible spectrum.

Early multi-color display patents such as U.S. Pat. No. 2,925,532 teach employing a planar array of discrete phosphor regions which reside between two sets of spaced apart strip conductors. The strips in one set of conductors are normal to the strips in the other set of conductors. This crossed relationship allows individual phosphor regions to be selectively activated. U.S. Pat. No. 5,047,686 teaches creating coplanar regions of phosphor of different light emitting characteristics by selectively doping regions of a continuous layer of phosphor. U.S. Pat. No. 4,862,033 teaches another method for generating a coplanar array of discrete phosphor regions of distinct compositions so as to produce distinct frequencies of emitted light.

The '033 patent also discloses multi-color displays where the phosphor layers responsible for the emissions are not coplanar. There are a variety of patents which also teach multiple layers of phosphor; these include the following U.S. Patents:

U.S. Pat. No. 4,908,603;

U.S. Pat. No. 5,043,715;

U.S. Pat. No. 5,294,869; and

U.S. Pat. No. 5,294,870.

The above described patents are limited in their teaching of multi-color thin film displays all of which require a large number of fine electrode leads to address the individual pixels which are responsible for the image. For thick films, the side-by-side phosphor regions cannot be individually addressed if the pixel size is small thereby limiting the resolution of the pattern which can be readily generated since thick film devices have course electrode leads. For the displays which employ non-coplanar phosphor elements, the intermediate layers required by the thick film technology will cause absorption of the light generated and thus a non-coplanar phosphor element will not be suitable for a thick film multi-color display.

While the limitations of printed multiple electrodes, particularly in the case of thick film displays place limits on the relative size of the distinct regions of the display, multiple electrodes in all cases would not be well suited to provide a marbled texture display.

Thus there is a need for a multi-color thick film display and method for making the same that will provide great flexibility in the colors displayed as well as to provide a uniform appearance in situations where the display is not energized.

OBJECTS OF THE INVENTION

It is an object of the invention to provide a method for making thick film electroluminescent multi-color display with pattern and color variation.

It is another object of the invention to provide a thick film electroluminescent multi-color display in which the multi-color properties of the display are present only when the display is energized.

It is still a further object of the invention to allow construction of a thick film electroluminescent display where the distribution of phosphor will create arbitrary or marbled distribution of the color of the screen when the display is energized.

It is yet a further object of the invention to provide a thick film electroluminescent display for a multi-color gauge or watch face.

SUMMARY OF THE INVENTION

The present invention is for a thick film multi-color electroluminescent display and method for making the same. The display of the present invention has a transparent or translucent substrate. The term transparent hereinafter will be used to describe both transparent and translucent materials. A transparent electrode is deposited onto the transparent substrate for the display.

A phosphor layer having at least a first phosphor region and a second phosphor region of differing composition is provided which is deposited onto the transparent electrode. The overall composition of each of the phosphor regions is defined as an integrated average over the region. For the lamp of the present invention, the composition of the first phosphor region and the second phosphor region of the phosphor layer is sufficiently distinct to provide a visually distinct light pattern from each of the regions when subject to an electric field.

A dielectric layer is deposited onto the phosphor layer. A second electrode is deposited onto the dielectric layer.

In one preferred embodiment there are multiple isolated phosphor segments between the transparent electrode and the second electrode. In this embodiment, at least one of the isolated phosphor segments has at least two phosphor regions of differing overall composition. It is further preferred that there are dielectric regions provided between the isolated phosphor segments.

Preferred methods for making the display of the present invention include the following steps. A flexible transparent substrate such as MYLAR® is selected onto which is deposited a transparent electrode such as indium tin oxide. Substrates with transparent electrodes deposited thereon are commercially available; such are known in the art and are discussed in applicant's copending application ELECTROLUMINESCENT LAMPS AND DISPLAYS HAVING THICK FILM AND MEANS FOR ELECTRICAL CONTACTS Ser. No. 08/189,989 which was filed on Jan. 31, 1994, now U.S. Pat. No. 5,410,217.

A phosphor layer is preferably printed onto the transparent electrode. This printing is preferably done by either screen printing with screening masks or halftone screens. When screen printing, the screening masks have regions of the screen impregnated with a filler leaving open regions where the ink can pass through to provide an image therebelow. In one preferred embodiment which employs screen printing, the phosphor layer is printed using multiple screening masks as described above, with each of the screening masks providing a pattern which is needed to generate a phosphor region. These screening masks are indexed to assure registry of the printed regions. Printing by this technique produces a phosphor layer having regions of uniform composition and will provide a well defined interface between the regions of different colors.

In another preferred embodiment where printing is employed, the phosphor layer is printed with halftone screens. The halftone screens differ from the screening masks discussed above in that each of the halftone screens has a pattern of holes. The halftone screen is also provided with a reference mark. The holes generate dots which provide a halftone image. Each screen has a slightly different array of holes so that when the reference mark for each screen is placed at a reference point of the transparent substrate onto which the halftone screens are printed, the collective dots printed will generate a complete color image. The dot size is sufficiently small that resulting patterns of dots will provide the perception of a multi-color image since the eye will integrate the close spaced dots to provide a perceived color. This technique will allow the spectrum of color to vary in a quasi-continuous manner as perceived by the eye. With such a technique, a rainbow of colors can be generated.

In a third preferred embodiment, a phosphor layer is screen printed employing a mask to define the region to be printed with a marbled ink. The marbled ink can be provided by blending two inks, a base ink having a small quantity of a second ink added and this combination is distributed as droplets throughout the base ink. The combination of inks is blended for a limited time to provide a marbled ink which, when printed, provides a phosphor layer which will luminesce with a marbled spectra.

To complete the electroluminescent display device, a dielectric layer is provide which is preferably screen printed onto the phosphor layer. A second electrode is provided which is screen printed onto the dielectric layer.

BEST MODE OF CARRYING THE INVENTION INTO PRACTICE

Figure 1:
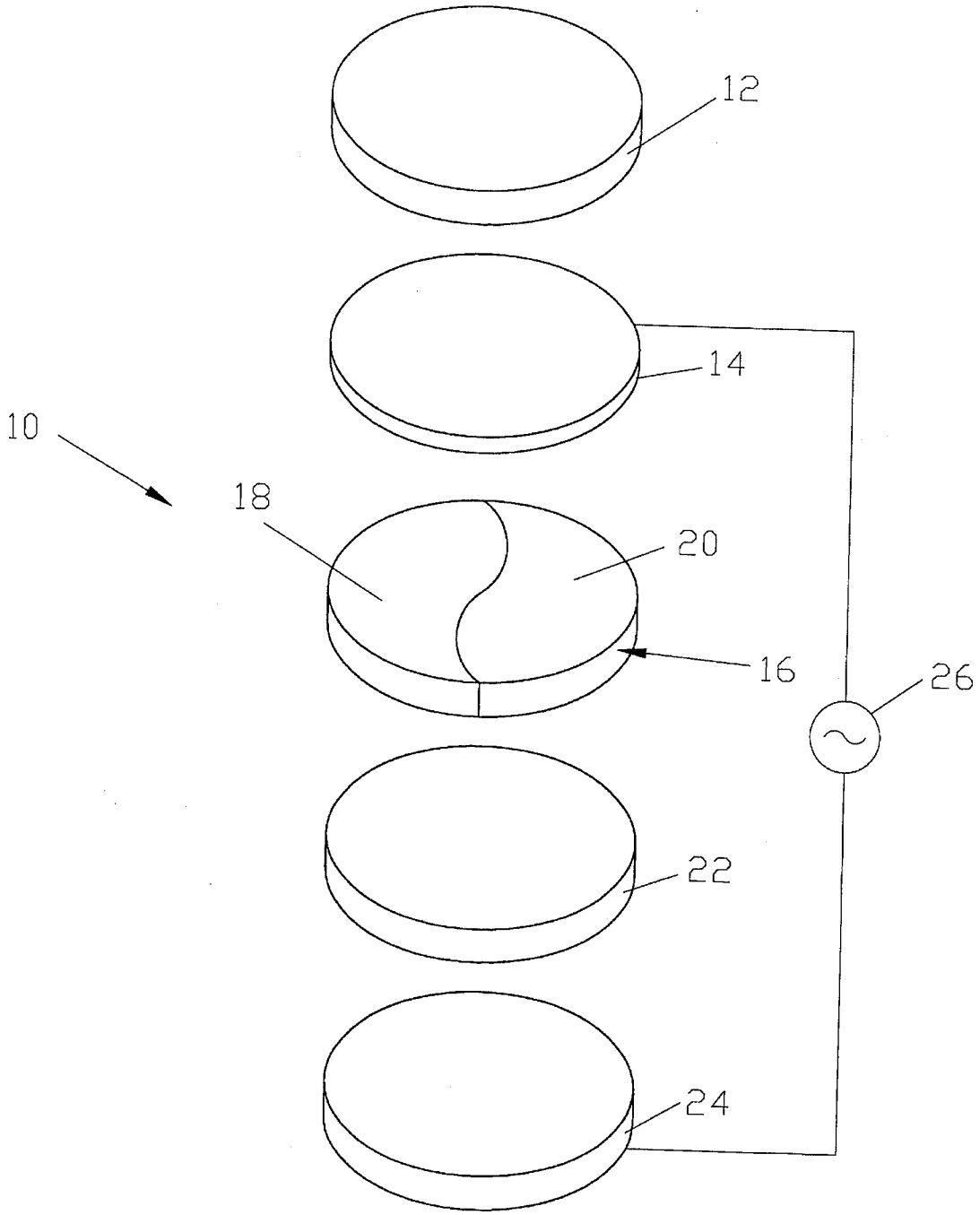
FIG. 1 is an exploded isometric view of one embodiment of a display of the present invention employing a phosphor layer having two regions which luminesce with different colors when subject to an electric field.
Figure 2:
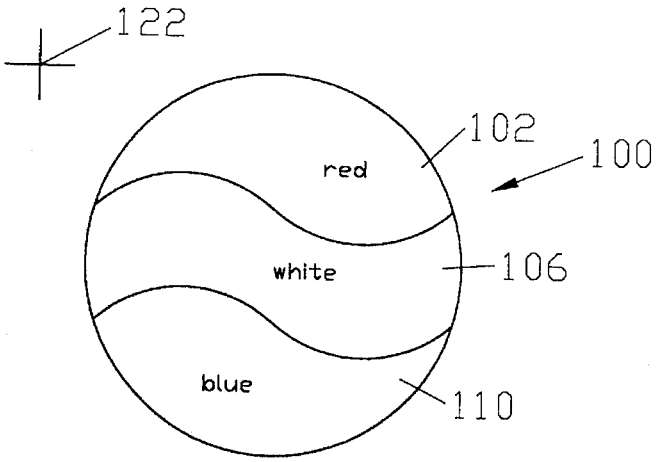
FIG. 2 is a display which is generated by screen printing three side-by-side bands of phosphor having differing chemistry. In this embodiment the phosphor inks selected for the printing were chosen to luminesce a red, a white and a blue stripe.

FIG. 1 is an exploded isometric view of one embodiment of the present invention for a multi-color lamp 10. The multi-color lamp 10 has a transparent substrate 12. Deposited onto the transparent substrate 12 is a transparent electrode 14. A phosphor layer 16 is deposited onto the transparent electrode 14. The phosphor layer 16 has a first phosphor region 18 having a homogeneous composition throughout and a second phosphor region 20 having a homogeneous composition throughout which differs from the chemistry of the first phosphor region 18. The two phosphor regions (18 and 20), since their compositions are different, will luminesce at different wavelengths when subject to a common electric field.

A dielectric layer 22 is deposited onto the phosphor layer 16. A second electrode 24 is deposited onto the dielectric layer 22. An AC power source 26 is connected to the transparent electrode 14 and the second electrode 24 to provide an AC voltage gradient through the phosphor layer 16. By adjusting the voltage in combination with the chemistry and thickness of the dielectric layer 22, the potential between the transparent electrode 14 and the second electrode 24 can be maintained at a level needed to cause the phosphor regions (18 and 20) to luminesce.

Depending on the method of printing, the character of the ultimate display can vary. Sharply contrasting images can be generated by screen printing while printing with halftone screens will allow gradual transformations from one color to another. The use of marbled inks which can be made by blending small quantities of one ink into another can offer a marbled appearance.

With the lamps described above, one can readily generate a variety of patterns with a single pair of electrodes as is further discussed below. The character of the resulting lamp will depend on the nature of the deposited phosphor layer.

FIGS. 2 through 5 illustrate a three region phosphor layer 100 along with the screening masks to screen print the striped pattern. The striped pattern, when screen printed, will provide distinct boundaries and maintain a constant chemistry throughout the stripes. The phosphor layer 100 is deposited with multiple printing, each of the stripes being printed with a different screening mask. A first stripe 102 is red and is printed with a first screen mask 104 (shown in FIG. 3). A second stripe 106 is white and is printed with a second screen mask 108 (shown in FIG. 4). A third stripe 110 is blue and is printed with a third screen mask 112 (shown in FIG. 5). These screen masks (104, 108 and 112) are indexed to maintain registry of the stripes and to provide a sharp interface between the various colors.

Figure 3:
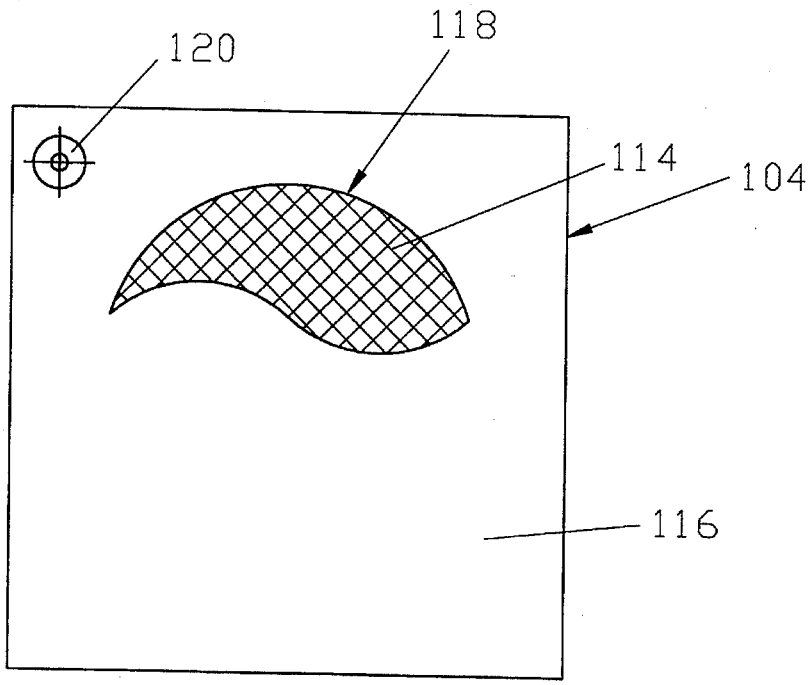
FIGS. 3 through 5 are representations of screen suitable for printing the striped regions of FIG. 2.
Figure 4:
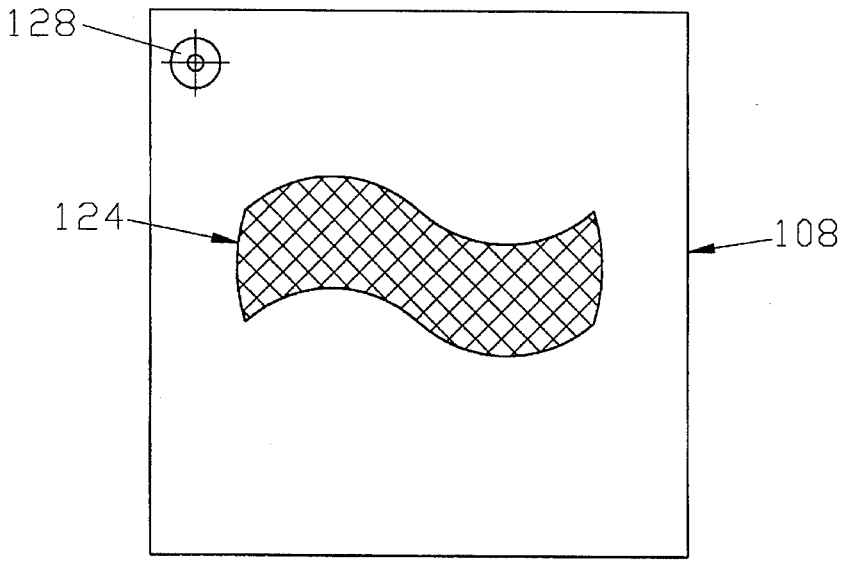
Figure 5:
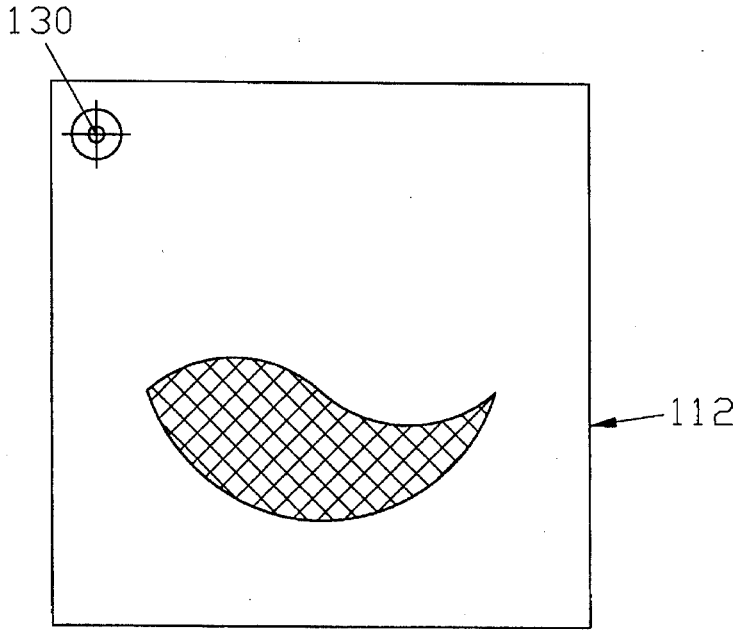

The phosphor layer 100 is printed with three screen masks (104, 108 and 112) illustrated in FIGS. 3 through 5. The first screen mask 104 is formed by a mesh 114 most of which is impregnated with a filler 116, leaving a first open region 118 through which the ink can pass. The first screen mask 104 has a first reference mark 120 which indexes on index mark 122 for the phosphor layer 100.

The second screen mask 108 has a second open region 124 used to print the second stripe 106. The second screen mask 108 has a second screen reference mark 128 which is aligned with the first reference mark 120 when the second screen mask 108 is printed.

Similarly, the third stripe 110 is printed with a third screen mask 112 providing a third reference mark 130 for the third stripe 110.

Figure 6:
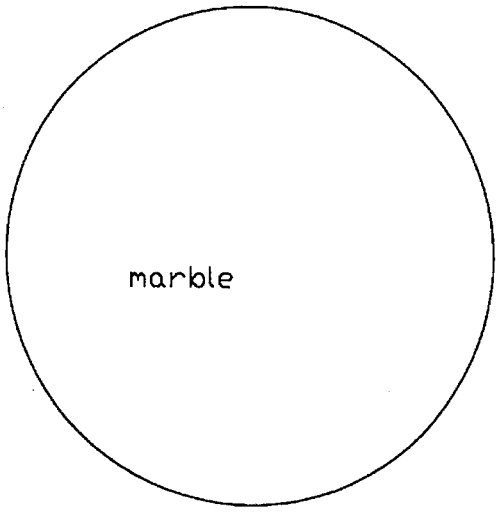
FIG. 6 is an illustration of a display where the composition of the phosphor layer is varied to provide a marbled pattern when the electrodes are energized.

FIG. 6 illustrates a marbled structure that can be generated by a lamp of the present invention. This electrode can be generated with a single screening mask. To generate this pattern, a marbled ink is employed. The marbled ink is of blue with yellow and can be made by using blue ink as a base into which are added small dispersed droplets of yellow ink allowing the two inks to be mixed for a short period of time allowing them to intermingle. When this ink is screen printed, it will provide a marbled appearance with stringers of yellow in a blue background.

Figure 7:
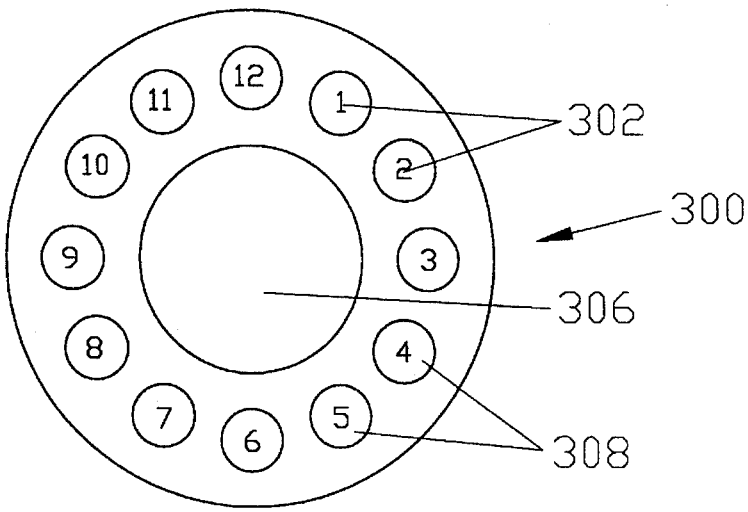
FIG. 7 is an illustration of an electroluminescent display which forms a watch dial. The composition of the phosphor provides a central circle of white and twelve smaller white circles below the numbers 1 through 12 printed on the watch face.

FIG. 7 is another phosphor pattern which can be used to back light or display a watch dial 300. The watch dial 300 has numbers 302 printed radially around the watch dial 300 to indicate the time. The display has a central circle 306 and smaller circles 308 which are printed with a phosphor ink which will highlight the numbers 302. The central circle 306 and the smaller circles 308 are printed with a first screening mask while the background is printed with a first screen and the balance of the phosphor layer is printed with a second screen.

Figure 8:
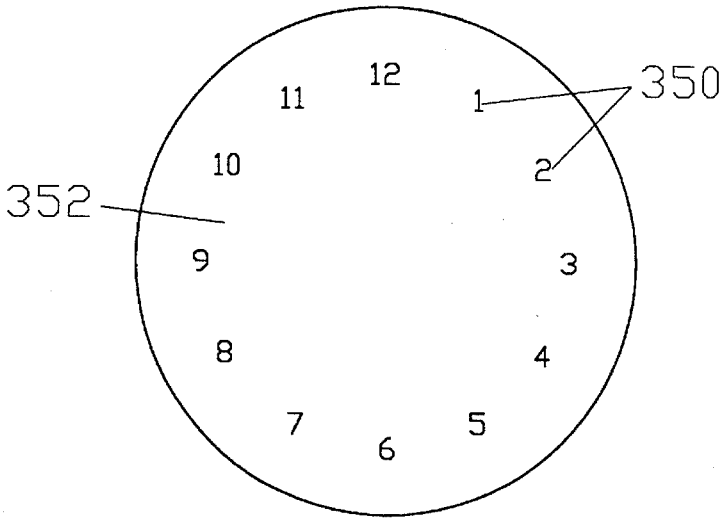
FIG. 8 is an illustration of a display for a watch dial which has a phosphor layer which is screen printed with two inks. The first ink is for the background and the second ink is for the numbers. In this embodiment, the numbers will not be seen unless the lamp is energized.

FIG. 8 is another pattern for a display where numbers 350 are visible only when light is provided. In this case, inks which are substantially separated in color when luminescing are selected for the numbers 350 and a background 352 and two inks are printed with two passes, one mask excluding the numbers and the second mask providing the numbers.

Figure 9:
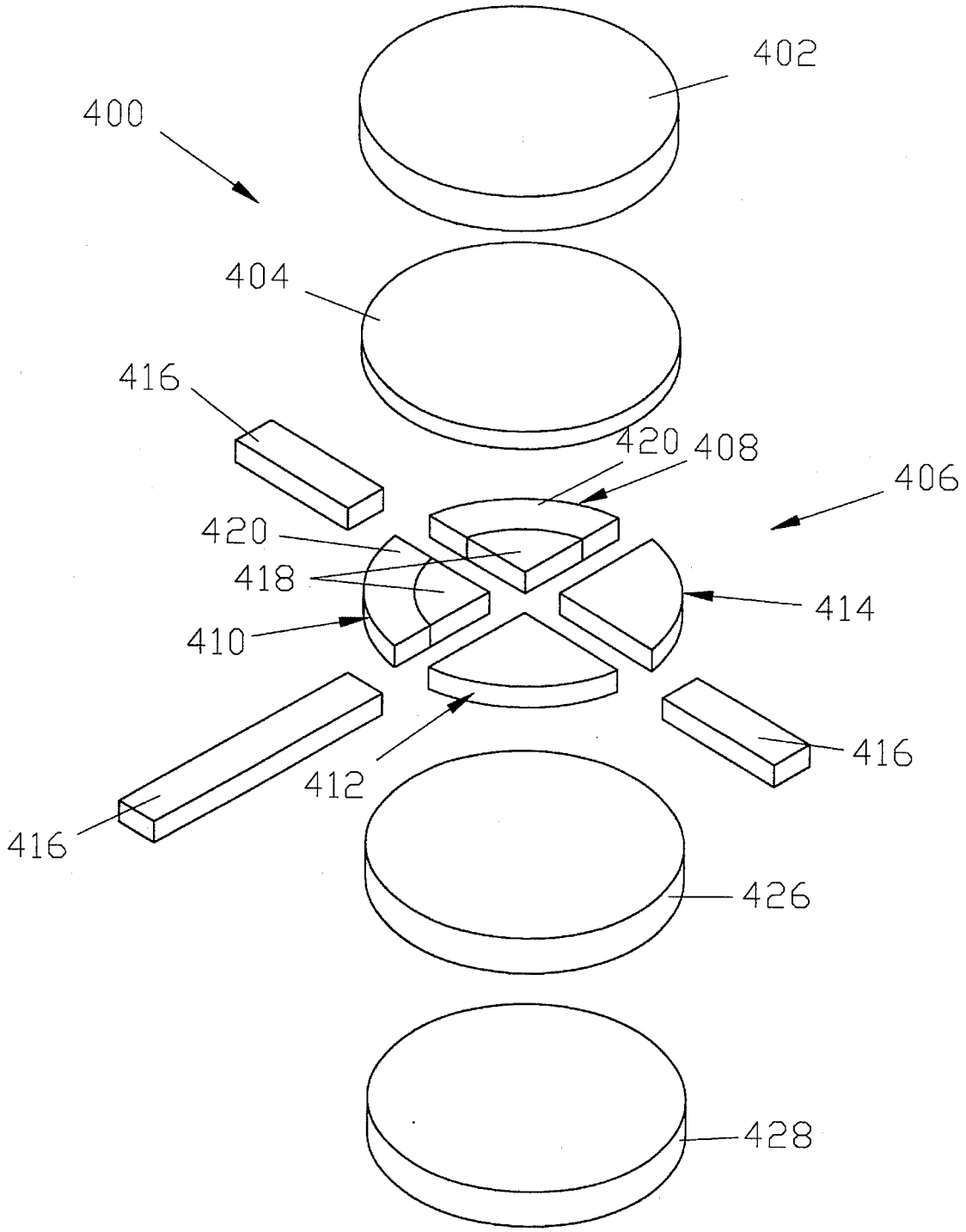
FIG. 9 is an exploded isometric view of a display similar to the lamp of FIG. 1; however, in this embodiment, there are multiple isolated phosphor segments. Two or the phosphor segments are screen printed providing a distinct interface between colors, a third is halftone printed to provide a rainbow effect, while the fourth region is printed with a single phosphor composition.

FIG. 9 is an exploded isometric view of a display 400. The display 400 has a transparent substrate 402 onto which is deposited a transparent electrode 404. A phosphor layer 406 has a first phosphor segment 408, a second phosphor segment 410, a third phosphor segment 412 and a fourth phosphor segment 414. The phosphor segments (408, 410, 412 and 414) are separated by dielectric regions 416. The first and second phosphor segments (408 and 410) are screen printed and have an inner region 418 of uniform composition and an outer region 420 of uniform composition.

The third phosphor segment 412 is uniform in composition and of the same composition of the outer region 420.

Figure 11:
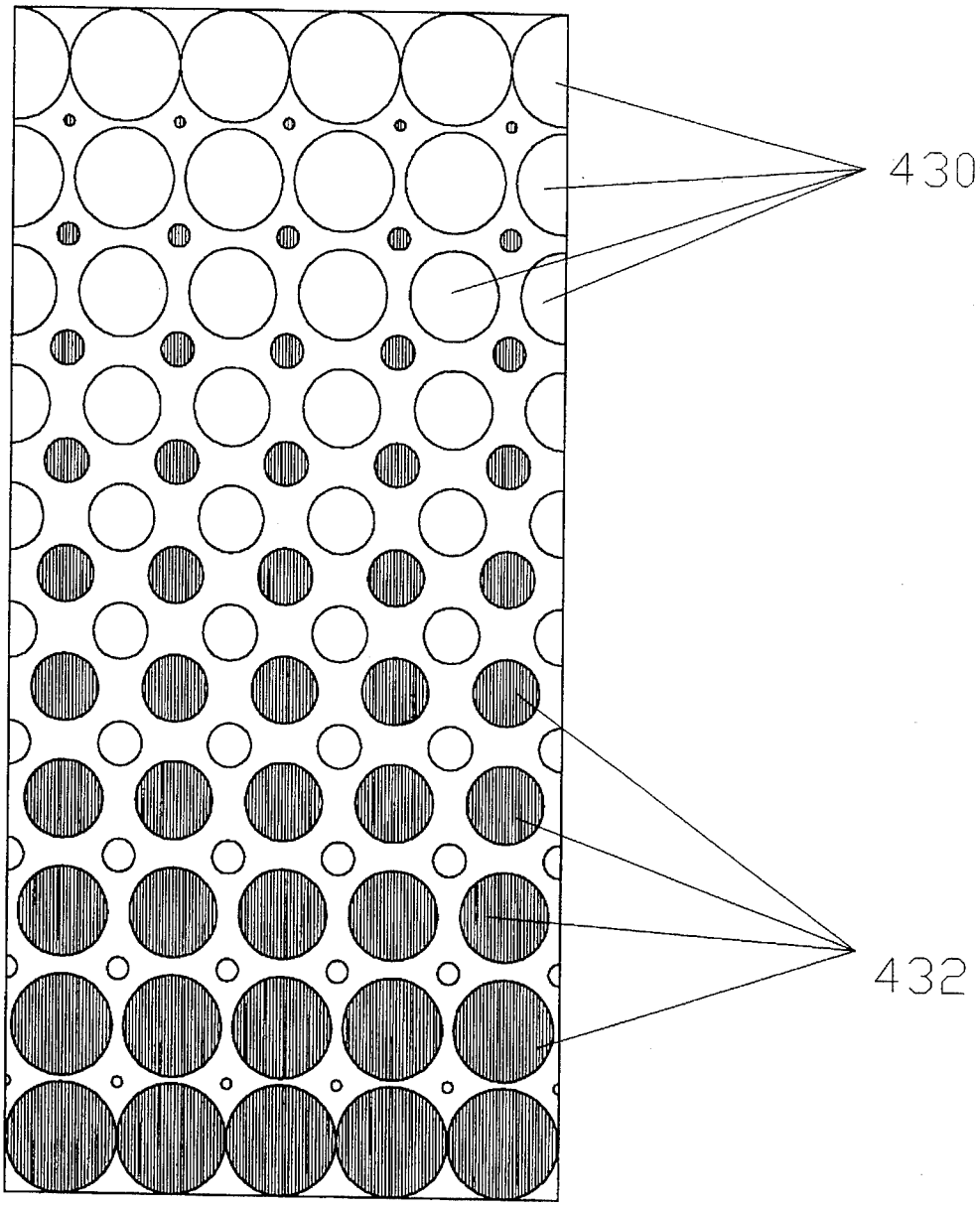
FIG. 11 is a detail view of the region 11 of FIG. 10 showing a multiplicity of dots formed by printing with halftone screens.

The fourth phosphor segment 414 is produced by screen printing and is of varying composition. The fourth phosphor segment 414 is produced by a series of halftone screens to provide a smoothly varying composition as a function of the distance from the center of the phosphor layer 406. Each of the halftone screens has a pattern of holes. The holes generate dots which provide a halftone image. Each screen has a slightly different array of holes so that the collective dots printed will generate a complete color image. FIG. 11 shows a first array of dots 430 printed by one halftone screen and a second array of dots 432 printed by a second halftone screen. The size of the dots (430 and 432) is sufficiently small that resulting patterns of dots will provide the perception of a multi-color image since the eye will integrate the dots to provide a perceived color. This technique will allow the spectrum of color to vary in a quasicontinuous manner as perceived by the eye.

A dielectric layer 426 is deposited onto the phosphor layer 406. Onto the dielectric layer 426 is deposited a second electrode 428.

Figure 10:
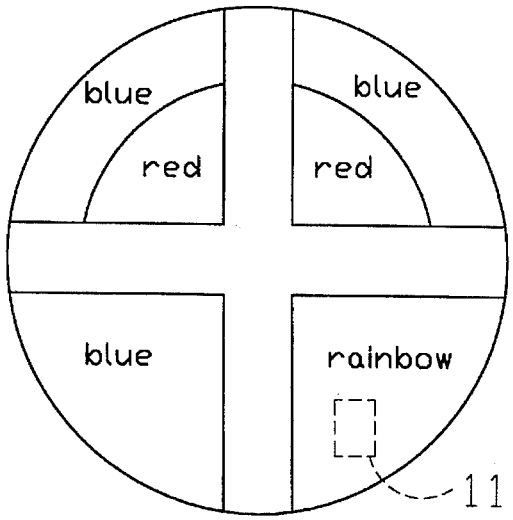
FIG. 10 is an illustration of a display which would result from the display having the phosphor layer illustrated in FIG. 9.

FIG. 10 illustrates a pattern generated by employing a multiple display of FIG. 9. There are four quadrants, the first and second quadrants are screen printed with two passes. The rainbow quadrant is formed b V a series of halftone screens and the fourth quadrant is produced with a single screen mask.

We claim:

1. A thick film multi-color display comprising:

a transparent substrate;

a transparent electrode deposited thereon;

a phosphor layer deposited thereon, said phosphor layer having at least two regions having different overall compositions providing visually distinct spectra of light, said compositions selected to luminesce when placed in a common electric field;

a dielectric layer deposited onto said phosphor layer; and a second electrode deposited on to said dielectric layer.

2. The multi-color display of claim 1 wherein said at least two regions of said phosphor layer have distinct homogenous compositions.

3. The multi-color display of claims 1 wherein said at least two regions of said phosphor layer are composed of a multiplicity of dots differing in chemistry, each of said regions having a distribution of said dots such that said dots collectively, when placed in an electric field, luminesce with a light which is distinct with respect to each of said regions.

4. A thick film multi-color display comprising:

a transparent substrate;

a transparent electrode deposited thereon;

a phosphor layer deposited onto said transparent electrode, said phosphor layer being formed using a marbled ink, said marbled ink comprising a mixture of a first phosphor ink and a second phosphor ink, said first phosphor ink and said second phosphor ink having compositions such that when said phosphor layer is placed in an electric field, said first phosphor ink and said second phosphor ink luminesce with light having visually different colors;

a dielectric layer deposited onto said phosphor layer; and a second electrode deposited onto said dielectric layer.

5. The thick film multi-color display of claim 4 wherein said marbled ink further comprises dispersed droplets of said second phosphor ink partially intermingled with said first phosphor ink.

6. A thick film multi-color display comprising:

a transparent substrate;

a transparent electrode deposited thereon;

a phosphor layer deposited thereon, said phosphor layer being deposited with at least two halftone screens, each of said at least two halftone screens being used to deposit a corresponding one of at least two phosphor compositions providing a visually distinct spectrum of light, said phosphor compositions selected to luminesce when placed in a common electric field;

a dielectric layer deposited onto said phosphor layer; and a second electrode deposited on to said dielectric layer.

* * * * *